US011555496B2

(12) United States Patent
Ripa et al.

(10) Patent No.: US 11,555,496 B2
(45) Date of Patent: Jan. 17, 2023

(54) CENTRIFUGAL PUMP

(71) Applicant: Nuovo Pignone Tecnologie Srl, Florence (IT)

(72) Inventors: Donato Antono Ripa, Gioia del Colle (IT); Fabrizio Milone, Bari (IT); Giulio Elicio, Ruva di Puglia (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 1 day.

(21) Appl. No.: 15/751,423

(22) PCT Filed: Aug. 3, 2016

(86) PCT No.: PCT/EP2016/068570
§ 371 (c)(1),
(2) Date: Feb. 8, 2018

(87) PCT Pub. No.: WO2017/025414
PCT Pub. Date: Feb. 16, 2017

(65) Prior Publication Data

US 2018/0238332 A1 Aug. 23, 2018

(30) Foreign Application Priority Data

Aug. 10, 2015 (IT) ..... 102015000043624

(51) Int. Cl.
*F04D 1/06* (2006.01)
*F04D 29/42* (2006.01)
(Continued)

(52) U.S. Cl.
CPC ..... *F04D 1/063* (2013.01); *F04D 1/06* (2013.01); *F04D 29/426* (2013.01); *F04D 29/448* (2013.01); *F04D 29/628* (2013.01)

(58) Field of Classification Search
CPC . F04D 1/06; F04D 1/063; F04D 1/066; F04D 1/10; F04D 29/426; F04D 29/447; F04D 29/448; F04D 29/628
See application file for complete search history.

(56) References Cited

U.S. PATENT DOCUMENTS 2,265,834 A * 12/1941 Garraway ..... F04D 1/063 415/175
2,374,122 A * 4/1945 Nelson ..... F04D 1/063 415/100

(Continued)

FOREIGN PATENT DOCUMENTS

CN 2859040 Y 1/2007
CN 101818733 A 9/2010

(Continued)

OTHER PUBLICATIONS

JP 2005036797_Translated Description_Hiroyuki et al. (Feb. 10, 2005).*

(Continued)

*Primary Examiner* — Topaz L. Elliott
*Assistant Examiner* — Aye S Htay
(74) *Attorney, Agent, or Firm* — Baker Hughes Patent Organization

(57) ABSTRACT

A centrifugal pump including an outer case; an inner case; a first unit and a second unit placed in fluid communication with each other, each unit including a plurality of impellers; the inner case includes two half-parts joined along a connection plane containing the axis of rotation; a connecting element is placed between the first unit and the second unit, the connecting element is engaged with a last impeller of the first unit and with a last impeller of the second unit.

8 Claims, 3 Drawing Sheets

(51) Int. Cl.
*F04D 29/44* (2006.01)
*F04D 29/62* (2006.01)

(56) References Cited

U.S. PATENT DOCUMENTS

| | | | | |
|---|---|---|---|---|
| 2,601,828 | A * | 7/1952 | Lobanoff | F04D 1/063 415/100 |
| 3,229,642 | A * | 1/1966 | Lobanoff | F04D 1/063 415/100 |
| 3,232,235 | A * | 2/1966 | Pilarczyk | F04D 1/063 415/140 |
| 3,861,825 | A * | 1/1975 | Blom | F04D 1/06 415/104 |
| 2011/0229308 | A1* | 9/2011 | Welschinger | F04D 7/04 415/121.2 |
| 2015/0330391 | A1* | 11/2015 | Bergamini | F04D 1/066 415/198.1 |
| 2018/0080471 | A1* | 3/2018 | Sekino | F04D 1/06 |

FOREIGN PATENT DOCUMENTS

| | | | |
|---|---|---|---|
| CN | 201763613 | U | 3/2011 |
| CN | 102878104 | A | 1/2013 |
| CN | 203189272 | U | 9/2013 |
| CN | 203214340 | U | 9/2013 |
| JP | 2005-036797 | A | 2/2005 |
| WO | 2014/086730 | A1 | 6/2014 |

OTHER PUBLICATIONS

Italian Search Report and Written Opinion issued in connection with corresponding IT Application No. 102015000043624 dated Apr. 8, 2016.

International Search Report and Written Opinion issued in connection with corresponding PCT Application No. PCT/EP2016/068570 dated Dec. 15, 2016.

International Preliminary Report on Patentability issued in connection with corresponding PCT Application No. PCT/EP2016/068570 dated Feb. 13, 2018.

* cited by examiner

CENTRIFUGAL PUMP

BACKGROUND OF THE INVENTION

The subject matter of the present disclosure relates to a centrifugal pump. Specifically, this disclosure relates to a centrifugal diffuser pump of the barrel type in a back-to-back configuration. This kind of pump can be usefully employed in the oil and gas industry, as well as in any industrial process in which there is a need to increase the pressure of a large amount of fluid continuously or nearly continuously.

Moreover, it is to be noted that a centrifugal pump is different from other kind of turbomachines, such as compressors. A pump processes a fluid that is in liquid state, while a compressor operates on a fluid that is non-liquid (such as steam or gas) for at least a portion of the working cycle.

In the state of the art, a barrel pump comprises an outer case, named "barrel" in the technical jargon, and an inner case, called "cartridge". For high pressure applications the flow path arrangement of a barrel pump (such as API BB5 volute or diffuser) is back-to-back. This is done in order to reduce the residual axial thrust, to increase the efficiency (since the balancing drum sees half the total differential pressure) and to increase the rotordynamic stability of the pump.

In the back-to-back configuration, the pump comprises two counterpoised sets of impellers, each with its respective diffuser. Each set of impellers is called a "phase" in the technical jargon. A special diaphragm, known as inversion module, takes the outlet flow of the first phase and delivers it in the gap between the cartridge and the barrel to feed the suction of the second phase. The inversion module also takes the outlet flow rate of the second phase and delivers it to the outlet flange.

Back-to-back pumps of the type described above are radially split pumps. This means that the inner case is composed by radially stacking diffusers and diaphragms. Rotor and inner case are assembled during the same phase alternating the installation of each impeller with a statoric component.

The above described pump has several drawbacks. Indeed, the inversion module has a complex geometry, which requires that it is made by casting. Therefore, the inversion module is difficult to manufacture.

Moreover, the inversion module incurs very high hydrodynamic losses, as, due to its complex geometry, the fluid is forced into a path with several turns having a very small radius.

Also, it is not possible to balance the rotor, but each impeller has to be balanced separately.

Finally, if the impellers are attached by shrink fit, disassembling them is very complicated, mainly due to inaccessibility of the back of the last impeller which is enclosed by the stator.

SUMMARY OF INVENTION

A first embodiment of the invention therefore relates to a centrifugal pump comprising an outer case and an inner case enclosed in the outer case. Also, the pump comprises at least a first unit and a second unit. The units are placed in fluid connection with each other so that the second unit processes the process fluid discharged from the first unit. Each unit comprises a plurality of impellers having an axis of rotation. Each unit also comprises a plurality of diffusers. Each diffuser is placed around a respective impeller.

The inner case comprises two half-parts joined along a connection plane containing the axis of rotation. Also, each diffuser comprises two half-parts joined along the connection plane.

The centrifugal pump further comprises a connecting element between the first unit and the second unit, the connecting element being engaged with a last impeller of the first unit and with a last impeller of the second unit.

A second embodiment relates to a centrifugal pump, comprising:

a first unit having a first impeller configured to rotate about an axis of rotation, the first unit having a first inlet and a first outlet;

a second unit having a second impeller configured to rotation about the axis of rotation, the second unit having a second inlet fluidly coupled with the first outlet of the first unit; and a first case positioned about the first unit and the second unit, the first case having a first longitudinal axis parallel the axis of rotation and split along the first longitudinal axis.

The centrifugal pump may further comprise a connecting element between the first outlet and the second inlet, wherein the connecting element is configured to engage the first impeller and the second impeller.

The centrifugal pump may also further comprise a second outer case about the first case.

A third embodiment of the invention relates to a connecting element which is configured to join a first and a second unit of a centrifugal pump. The connecting element comprises a main body. A first and a second diffuser are inserted into the main body. The diffusers are configured to engage with a last impeller of the first unit and with a last impeller of the second unit respectively.

BRIEF DESCRIPTION OF THE DRAWINGS

Additionally, the main body is provided with a groove surrounding at least in part the first diffuser.

Further details and specific embodiments will refer to the attached drawings, in which.

DETAILED DESCRIPTION

Figure 1:
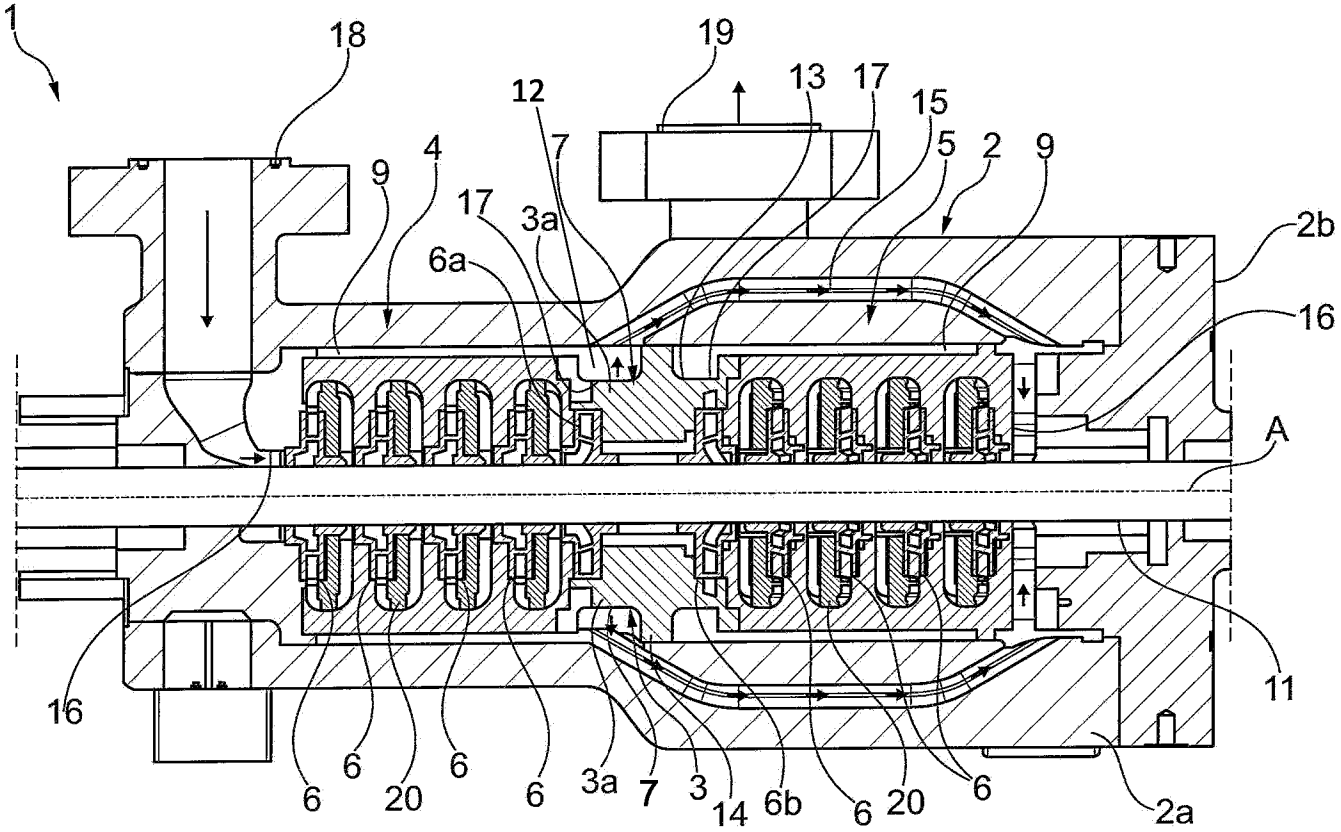
FIG. 1 is a sectional view of a centrifugal pump.

The following description of exemplary embodiments refers to the accompanying drawings. The same reference numbers in different drawings identify the same or similar elements. The following detailed description does not limit the invention. Instead, the scope of the invention is defined by the appended claims.

The following disclosure describes in detail a centrifugal pump, which is a machine that performs work when provided energy from an outside source. Specifically, centrifugal means that it accelerates a process fluid in a radial direction from the center to a peripheral zone. With more detail, the specific embodiment described in this disclosure relates to a centrifugal pump, which is a pump that increases the pressure of a process liquid in such manner. Indeed, this pump is of the axially split back-to-back type. Axially split means that the outer components are split along a plane that includes the central rotation axis. Back-to-back is a configuration in which the pump comprises two sub-units that are assembled facing away from each other.

With reference to the attached drawings, with the number 1 is indicated a centrifugal pump according to an embodiment of the present invention. Specifically, the centrifugal pump 1 described herewith is an axially split centrifugal pump. However, no loss of generality is intended, since all the concepts described within the present disclosure can be readily applied to all other centrifugal pumps in a manner that will be clear for the person skilled in the art.

Specifically, the centrifugal pump 1 comprises an outer case 2. An inner case 3 is enclosed in the outer case 2. As explained before, this kind of configuration is called "barrel". The outer case 2 is provided with both an intake flange 18 and a discharge flange 19. When the centrifugal pump 1 is connected to the plant, the process fluid enters through the intake flange 18 and exits through the discharge flange 19.

The pump 1 comprises at least a first unit 4 and a second unit 5. The first unit 4 and the second unit 5 are designed to compress the process fluid on their own, and each is provided with a respective intake duct 16 and discharge duct 17.

Furthermore, the units 4, 5 are placed in fluid connection with each other so that the second unit 5 processes the process fluid discharged from the first unit 4. In other words, the two units 4, 5 operate serially. Still in other words, the intake duct 16 of the second unit 5 is placed in direct fluid communication with the discharge duct 17 of the first unit 4. It is to be noted that further units, not shown in the attached drawings, can also be optionally attached in the same manner downstream of the second unit 5.

To process the fluid, each unit 4, 5 comprises a plurality of impellers 6 having an axis of rotation "A". Indeed, the impellers of the first unit 4 and of the second unit 5 are attached onto a shaft 11, which provides the power used for compressing the process fluid. Therefore, all of the impellers 6, 6*a*, 6*b* share the same axis of rotation "A".

Also, for each of the units 4, 5 a chamber 9 is provided between the outer 2 and the inner case 3. Indeed, the discharge 17 of each unit 4, 5 is placed in fluid communication with the respective chamber 9. The chamber of the first unit 4 is placed in fluid communication with the intake duct 16 of the second unit 5. The chamber 9 of the second unit 5 is placed in fluid communication with the discharge flange 19 of the centrifugal pump 1.

With more detail, the inner case 3 comprises two half-parts 3*a*. These half-parts 3*a* are joined along a connection plane, which may contain the axis of rotation "A".

The outer case 2, on the other hand, comprises a main body 2*a* and a cover 2*b*. Typically, the main body 2*a* is hollow, may be cylindrically shaped and with an open side. The cover 2*b* has a shape which is complementary to that of the main body 2*a*, and is designed to engage the main body 2*a* so that it can be sealed once the other part of the centrifugal pump 1 are assembled inside the main body 2*a*.

The centrifugal pump 1 comprises a connecting element 7 between the first unit 4 and the second unit 5. The connecting element 7 has the function of joining structurally the first unit 4 and the second unit 5. Indeed, a last impeller 6*a* of the first unit 4 is engaged with the connection element 7 Also, a last impeller 6*b* of the second unit 5 is engaged with the connecting element 7.

Figure 2:
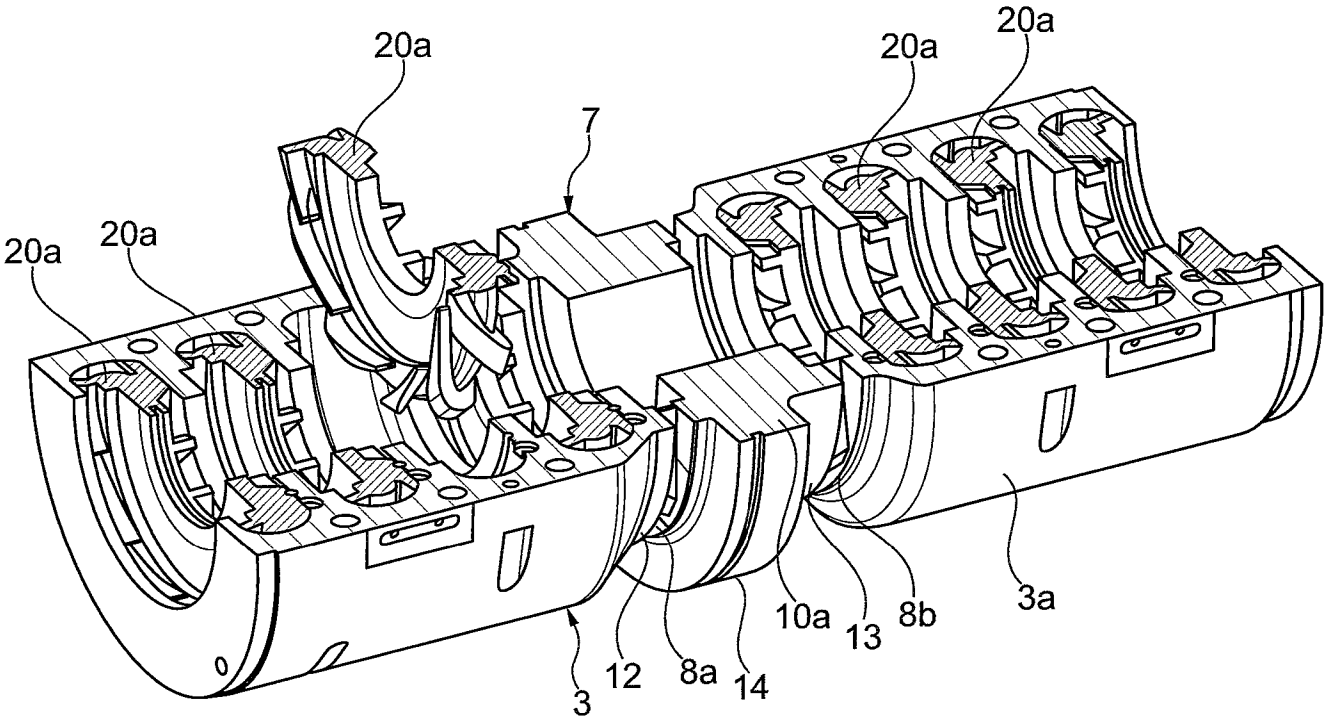
FIG. 2 is a perspective view of a detail of the centrifugal pump of FIG. 1.
Figure 3:
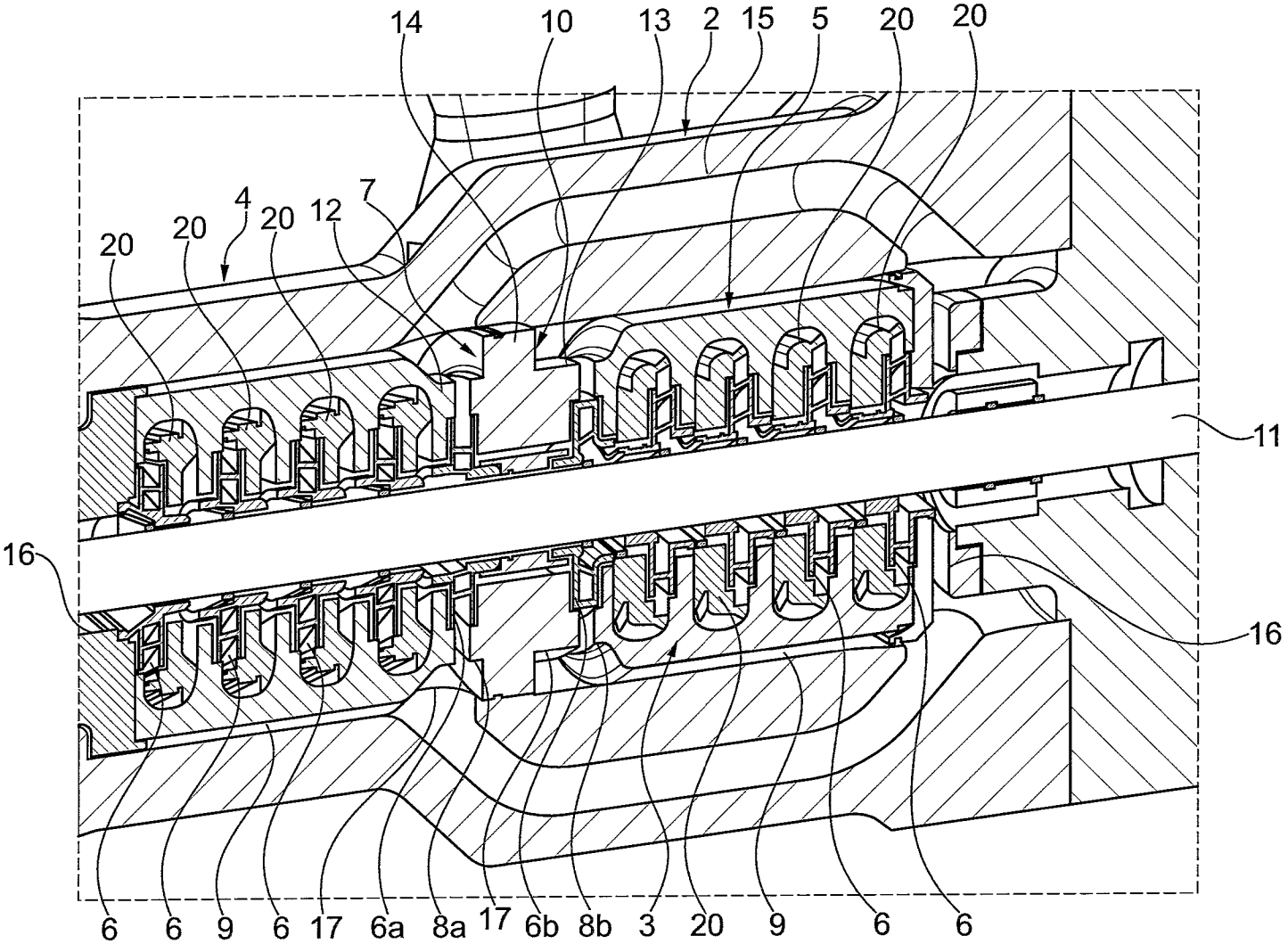
FIG. 3 is a perspective sectional view of a further detail of the centrifugal pump of FIG. 1.

Referring to FIG. 2, the connecting element 7 comprises a main body 10. A first diffuser 8*a* and a second diffuser 8*b* are inserted into the main body 7. The first diffuser 8*a* is placed around the last impeller 6*a* of the first unit 4. Similarly, the second diffuser 8*b* is placed around the last impeller 6*b* of the second unit 5. The first diffuser 8*a* is placed in fluid communication with the chamber 9 of the first unit 4. The second diffuser 8*b* is placed in fluid communication with the chamber 9 of the second unit 5.

It is to be noted that each unit 4, 5 comprises a plurality of further diffusers 20 for its other impellers 6. Indeed, each further diffuser 20 is placed around a respective impeller 6. Each further diffuser 20 comprises two half-parts 20*a* joined along the connection plane.

It is to be noted that the main body 10 is provided with a groove 12 surrounding at least in part the first diffuser 8*a*. Similarly, the main body 10 is provided with a further groove 13 surrounding at least in part the second diffuser 8*b*. Each groove 12, 13 is placed into fluid communication with its respective chamber 9 and discharge 17, so that for each unit 4, 5 the process fluid exits from the discharge 17, flows into the groove 12, 13 through the respective diffuser 8*a*, 8*b* and enters the chamber 9.

Indeed, a seal 14 is placed between the groove 12 and the further groove 13. In the area of the seal 14, the inner case 3 is placed in contact with the outer case 2, effectively separating the chambers 9 of each unit 4, 5.

With more detail, the main body 10 is configured to define at least in part the above described inner case 3 of the centrifugal pump 1. In other words, the main body 10 is part of the inner case 3 of the centrifugal pump 1, and so it also comprises two half-parts 10*a*, each attached to a respective half-part 3*a* of the inner case 3. In an embodiment, each half-part 10*a* of the main body 10 is made as a single piece with a respective half-part 3*a* of the inner case 3. Indeed, also the first diffuser 8*a* and the second diffuser 8*b* may be made as a single piece with the main body 10.

Referring to FIG. 1, the centrifugal pump 1 also comprises a duct 15, which is placed in fluid communication with the chamber 9 of the first unit 4 and with the intake duct 16 of the second unit 5.

Indeed, the duct 15 is placed externally with respect to the inner case 3. In the embodiment shown in the drawings, the duct 15 is integrated into the outer case 2. In an embodiment, in this way the pressure of the process fluid inside the duct 15 will push the two half-parts 3*a* of the inner case 3 together. Therefore, the joining of the two half-parts 3*a* does not have to bear a great load. For example, if the joining of the two half-parts 3*a* is done with screws (or bolts), then smaller screws (or bolts) are enough for this application, thanks to the contribution of the pressure from inside the duct 15.

In alternative embodiments, not shown in the drawings, the duct 15 may be separate from the outer case 2, and may even be, at least in part, run externally with respect to the outer case 2.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A centrifugal pump, comprising:

an outer case;

an inner case enclosed in the outer case;

at least a first unit and a second unit placed in fluid communication with each other, each unit having an intake duct and a discharge duct and a chamber bounded by the outer and the inner cases, the intake duct of the second unit being coupled with the discharge duct of the first unit, each unit comprising a plurality of impellers having an axis of rotation and a plurality of diffusers, each placed around a respective impeller;

the inner case comprising two half-parts joined along a connection plane containing the axis of rotation;

and each diffuser comprises two half-parts joined along the connection plane, the centrifugal pump comprising a connecting element between the first unit and the second unit, the connecting element being engaged with a last impeller of the first unit and with a last impeller of the second unit, the centrifugal pump comprising a third duct integrated into the outer case, external to the inner case and in fluid communication with the chamber of the first unit and with the intake duct of the second unit, wherein the pressure of a process fluid inside the third duct pushes the two half-parts of the inner case together.

2. The centrifugal pump according to claim 1, wherein said connecting element comprises a main body, a first diffuser and a second diffuser inserted into the main body and placed around the last impeller respectively of the first unit and of the second unit.

3. The centrifugal pump according to claim 2, wherein the first diffuser and the second diffuser being placed in fluid communication with the chamber of the first unit and of the second unit respectively.

4. The centrifugal pump according to claim 1, further comprising a discharge flange placed on the outer case, wherein the chamber of the second unit is placed in fluid communication with the discharge flange.

5. The centrifugal pump according to claim 2, wherein the main body comprises two half-parts, each made as a single piece with a respective half-part of the inner case.

6. The centrifugal pump according to claim 2, wherein the main body is configured to define at least in part the inner case of the centrifugal pump.

7. The centrifugal pump according to claim 1, wherein the outer case comprises a main body and a cover, wherein the cover is configured to seal the main body.

8. The centrifugal pump according to claim 1, wherein the connecting element comprises a main body fitted between the two half-parts of the inner case, the main body comprises two half-parts, and one of the two half-parts of the main body is attached to one of the two half-parts of the inner case, and the other of the two half-parts of the main body is attached to the other of the two half-parts of the inner case.

* * * * *